US008106250B2

(12) United States Patent
de Almeida et al.

(10) Patent No.: US 8,106,250 B2
(45) Date of Patent: Jan. 31, 2012

(54) PROCESS FOR REMOVING SILICON COMPOUNDS FROM HYDROCARBON STREAMS

(75) Inventors: Rafael Menegassi de Almeida, Rio de Janeiro (BR); Carlos René Klotz Rabello, Rio de Janeiro (BR); Marcus Vinicius Eiffle Duarte, Rio de Janeiro (BR); Guilherme Luis Monteiro de Souza, Niteroi (BR); Joyce Leslie, legal representative, Niteroi (BR); Xiaondong Hu, Louisville, KY (US)

(73) Assignee: Petroleo Brasileiro S.A.-Petrobras, Rio De Janeiro (BR)

( * ) Notice: Subject to any disclaimer, the term of this patent is extended or adjusted under 35 U.S.C. 154(b) by 245 days.

(21) Appl. No.: 12/510,371

(22) Filed: Jul. 28, 2009

(65) Prior Publication Data

US 2010/0038287 A1 Feb. 18, 2010

(30) Foreign Application Priority Data

Jul. 28, 2008 (BR) ..... 0802431

(51) Int. Cl.
*C07C 7/12* (2006.01)

(52) U.S. Cl. ..... 585/820; 585/823; 208/299

(58) Field of Classification Search ..... None
See application file for complete search history.

(56) References Cited

U.S. PATENT DOCUMENTS 4,176,047 A 11/1979 Orrell et al.
4,269,694 A 5/1981 Holland et al.
4,343,693 A 8/1982 Holland et al.
4,344,841 A 8/1982 Johnson et al.
4,645,587 A * 2/1987 Kokayeff ..... 208/91
5,118,406 A 6/1992 Kokayeff et al.
5,358,701 A * 10/1994 Pinnavaia et al. ..... 423/242.1
5,441,630 A 8/1995 Dai et al.
5,750,453 A * 5/1998 Easley et al. ..... 502/84
6,576,121 B2 6/2003 Zeuthen et al.
7,713,408 B2 * 5/2010 Breivik et al. ..... 208/213

FOREIGN PATENT DOCUMENTS

WO WO-2008129034 * 10/2008

OTHER PUBLICATIONS

Kellberg, Lars et al., "Deactivation of HDT Catalysts by Formation of Silica Gels from Silicone Oil. Characterization of Spent Catalysts from HDT of Coker Naphtha Using 29Si and 13C CP/MAS NMR", Journal of Catalysis 143, (1993), pp. 45-51.

Yang, Weishen et al, "A Study by in Situ Techniques of the Thermal Evolution of the Structure of a Mg-A1-CO3 Layered Double Hydroxide", Chemical Engineering Science 57, (2002), pp. 2945-2953.

* cited by examiner

*Primary Examiner* — Tam M Nguyen

(74) *Attorney, Agent, or Firm* — Nixon & Vanderhye P.C.

(57) ABSTRACT

The present invention relates to a process for removing organic silicon compounds from hydrocarbon streams by contact with an adsorbent and hydrogen. The adsorbent is composed of lamellar double hydroxides and group VI-B or group VIII hydrogenating metal. More specifically, the process of the present invention involves a stage of activation for formation of the lamellar double hydroxide, and maintaining the phase of lamellar double hydroxide by adding water.

28 Claims, No Drawings

PROCESS FOR REMOVING SILICON COMPOUNDS FROM HYDROCARBON STREAMS

This application is based upon and incorporates by reference, the contents of Brazilian Patent Application No. PI 0802431-6 filed Jul. 28, 2008.

FIELD OF THE INVENTION

The present invention relates to a process for removing organic compounds of silicon from a hydrocarbon stream. More specifically, the process comprises the adsorption of said silicon compounds on a porous solid containing metal with hydrogenating capacity from group VI-B or VIII on a support composed, largely of lamellar double hydroxides such as hydrotalcite, in the presence of water and hydrogen.

BACKGROUND OF THE INVENTION

The contamination of hydrocarbon streams by silicon-containing compounds results principally from the use of antifoaming agents in various stages of petroleum refining, or even in production. The antifoaming agents commonly used are the polydimethylsiloxanes, known as silicone.

Silicone is used as antifoaming agent in the process of delayed coking, preventing the entrainment of solids by reducing the formation of foam, in the process, due to the low surface tension of silicone. In delayed coking the residue from the vacuum distillation of petroleum is converted thermally to coke and to lower-boiling fractions, such as coke naphtha and light and heavy coke gas oils.

The high contents of sulphur, nitrogenated compounds and olefinic compounds present in the product streams from delayed coking make treatment necessary for upgrading of the streams as components of gasoline and diesel. Subsequent processes of hydrofining (for naphtha and gas oil) and catalytic reforming (for naphtha) are commonly used.

The polydimethylsiloxanes, however, are also converted in the coke drum (or some other stage of refining in which temperatures above 400° C. are employed), preferentially forming cyclosiloxanes, of lower boiling point, and which distil preferentially in the boiling range of naphtha. Analysis of coke naphthas shows typical contents of 1 to 10 ppm Si, possibly greater, besides contents of olefins, sulphur and nitrogenated compounds that make subsequent treatment necessary.

The problem is that these compounds containing Si have an adverse effect in the subsequent treatment units and must be absent from the final fuel. The Si compounds poison the catalytic reforming catalysts and accumulate in the catalyst beds of the hydrofining units, deactivating the catalyst and shortening the campaign time. They also impede regeneration of the contaminated hydrofining catalysts, by forming a film, of $SiO_2$ on the metallic sites of the catalyst on oxidation of the adsorbed compounds. Hydrofining catalysts are constituted of group VIII metal (normally Co or Ni) and group VI-B metal (normally Mo or W) supported on a suitable porous solid, alumina.

U.S. Pat. No. 4,176,047 discloses a process for removing Si compounds present in coke naphtha, where the Si compound is removed in a bed of material such as alumina, activated alumina or spent desulphurization catalyst (which uses alumina as support). Temperatures above 90° C., preferably 120° C. to 150° C. are used for removing the Si compounds. The stream contaminated with silicon compounds is treated before hydrofining (HF) and catalytic reforming. No information is supplied concerning the capacity for retention of Si in these conditions (amount of Si that the bed is able to retain in the claimed operating conditions).

U.S. Pat. No. 4,269,694 and U.S. Pat. No. 4,343,693 relate to the use of bauxite (aluminium ore) for the adsorption of contaminants, including silicone, in hydrocarbon streams. Bauxite is mainly composed of hydroxides and oxides of aluminium, and at lower contents iron, silica and titania. A treatment temperature of an adsorption bed of up to 320° C., more preferably between 65° C. and 177° C., is claimed, and WHSV between 1 and 5. Preferably, after trapping of the Si compounds, the hydrocarbon stream is hydrofined. U.S. Pat. No. 4,344,841 of the same inventor discloses the use of other materials in the adsorption bed, such as montmorillonite clays, silica (amorphous), and mixtures of one or the other and with bauxite. Typical bed saturation contents of 5 wt. % are reached in the aforementioned inventions.

U.S. Pat. No. 5,118,406 deals with optimization of the beds of hydrofining process reactors for ensuring greater process stability when contaminants containing Si are present in the feed. The patent discloses that catalysts with lower activity and greater area must be positioned before catalysts that are more active, with smaller area. The use of catalysts with greater area (and lower metal content and activity), with greater adsorption capacity, followed by the catalyst that is more active, permits longer campaign times at equal reactor volume.

Catalysts supported on alumina with greater area and lower metal content are available commercially, for use before the main HF catalyst. The literature suggests that a greater catalyst area results in greater capacity for retention of Si, according to Kellberg et al. (KELLBERG, L; ZEUTHEN, P.; JAKOBSEN, H. J. *Deactivation of HDT catalysts by formation of silica gels from silicone oil, characterization of spent catalysts from HDT of coker naphtha using* $^{29}Si$ *and* $^{13}C$ *CP/MAS NMR*—Journal of Catalysis, Vol. 143, No. 1, p. 45-51, 1993). Contents of up to 7.5 wt. % of Si are reached with catalysts supported on alumina of high surface area. Moreover, the authors suggest that the trapping of the organic Si compounds occurs by reaction of surface dehydration, where a silanol is anchored to a hydroxyl exposed on the surface of the alumina, eliminating $H_2O$. Once the catalyst is saturated with Si, it cannot be regenerated: there is formation of a film of $SiO_2$ in regeneration, which covers the metallic sites responsible for the activity of the catalyst.

U.S. Pat. No. 6,576,121 proposes the hydrofining of feedstock contaminated with Si, additionally processing a volume of water from 0.01% to 10% relative to the feed volume. It is suggested that the presence of water increases the concentration of hydroxyls exposed on the surface of the alumina, and thus increases the capacity for retention of Si. A gain in capacity of up to 22% is obtained compared to the case without treatment with water, using a standard test. However, it is known that the use of water in catalysts supported on alumina may lead to sintering and loss of catalytic activity.

Hydrodesulphurization catalysts supported on hydrotalcite, or containing hydrotalcite in the composition, are employed for selective hydrodesulphurization of naphtha from FCC (removal of the sulphur-containing compounds with less hydrogenation of the olefins), according to U.S. Pat. No. 5,441,630. Hydrotalcite is one of the lamellar double hydroxides, also called hydrotalcite-like compounds. The lamellar double hydroxides have the general chemical formula $$[M_{1-x}^{II}M_x^{III}(OH)_2]^{x+}(A_{x/n}^{n-})mH_2O$$

where $M^{II}$ is a divalent cation (Mg, Mn, Fe, Co, Ni, Cu, Zn, Ga);

$M^{III}$ trivalent (Al, Cr, Mn, Fe, Co, Ni and La);

$A^{n-}$ represents an anion of valency n–, usually inorganic ($CO_3^{2-}$, $OH^-$, $NO^{3-}$, $SO_4^{3-}$, $ClO_4^-$, $Cl^-$), heteropolyacids or even anions of organic acids. Typically, $0.2 \leqq x \leqq 0.33$ and m is less than 0.625.

The hydrotalcites are double hydroxides of Mg and Al, and the commonest composition is $$[Mg_6Al_2(OH)_{16}](CO_3)4H_2O$$

or $$[Mg_{0.75}Al_{0.25}(OH)_2]0.125(CO_3)0.5H_2O$$

with x=0.25.

Moreover, for use as support of HDS catalyst of naphtha from FCC, in the conditions of calcination the hydrotalcite loses $CO_2$ and $H_2O$, resulting in mixed oxide of Mg and Al, remaining thus in the typical conditions of hydrodesulphurization (temperatures above 280° C. and absence of water and $CO_2$).

Yang et al. (YANG, W.; KIM, Y.; LIU, P. K. T.; SAHIMI, M.; TOTSIS, T. T. *A study by in situ techniques of the thermal evolution of the structure of a Mg—Al—$CO_3$ layered, double hydroxide*—Chem. Eng. Sci, vol. 57, p. 2595, 2002) provide evidence of this behaviour of dehydration and decarboxylation of hydrotalcite during calcination, resulting in the mixed oxide of magnesium and aluminium. Further details on the behaviour of the hydrotalcites and lamellar double oxides can be found in the article by Crepaldi and Valim (CREPALDI, E. L.; VALIM, J. B.—Hidróxidos duplos lamelares: síntese, estrutura, propriedades e aplicações—Química Nova, Vol. 21, No. 3, p. 300-311, 1998), incorporated here as reference.

Despite the use for selective hydrodesulphurization of naphtha from FCC, in the form of its mixed oxide, the prior literature does not cite or suggest the use of the catalyst as adsorbent of Si compounds.

The importance of processes of conversion of petroleum bottoms product (heavy hydrocarbons) to light distillates, such as delayed coking, and the need for clean fuels with lower content of contaminant by means of hydrofining, as well as the continuous development presented in the prior art show that more effective processes and catalysts for removing Si are desirable, which is achieved in the present invention.

The present invention provides the use of lamellar double hydroxides, such as hydrotalcite, as support of hydrofining catalyst or adsorbent, resulting in improvement to the state of the art for retention of silicon-containing compounds that contaminate hydrocarbon streams.

SUMMARY OF THE INVENTION

Broadly, the present invention relates to the removal of silicon compounds, present as contaminants in a hydrocarbon stream. The process involves contact of the contaminated stream with a lamellar double hydroxide, comprising the stages of:

a) activation of the adsorbent, formed by mixing oxides of divalent and trivalent metals, preferably MgO and $Al_2O_3$, to form a lamellar double hydroxide, like hydrotalcite, by addition of $H_2O$ and $CO_2$ at a temperature from 80° C. to 360° C., preferably from 110° C. to 220° C., more preferably 120° C. to 160° C. and pressure from 0.05 to 5.0 $Mpa_g$; preferably 0.05 to 2.0 $MPa_g$, more preferably from 0.05 to 0.2 $MPa_g$;

b) contact of the hydrocarbon feed with the adsorbent at a temperature from 80° C. to 360° C., preferably 160° C. to 320° C., more preferably from 220° C. to 280° C., at a pressure in the range from 0.5 to 5.0 $MPa_g$, preferably from 1.5 to 3.0 $MPa_g$, maintained for $H_2$/feed ratio from 10 to 1000 $Nm^3$ of gas/$m^3$ of feed, more preferably from 50 to 500 $Nm^3$ of gas/$m^3$ of feed and space velocity LHSV from 1 to 20 $h^{-1}$, preferably from 2 to 5 $h^{-1}$, in a reactor charged with said adsorbent;

c) maintaining said adsorbent in the condition of lamellar mixed hydroxide, by continuous addition of $H_2O$, the water flow rate being from 0.01% to 100%, preferably 0.1% to 20%, more preferably 0.1% to 10% of the volume of the hydrocarbon feed being processed;

d) recovery of the hydrocarbon stream free from Si compounds;

where said adsorbent comprises a mixture of:

(I)—porous lamellar double hydroxide, preferably hydrotalcite;

(II)—metal with hydrogenating or hydrogenolysing capacity of group VI-B or group VIII, preferably Mo, deposited on the hydrotalcite or lamellar double oxide, at contents less than 20 wt. % as oxide.

DETAILED DESCRIPTION OF THE INVENTION

The hydrocarbon streams that require treatment are typically naphthas obtained from delayed coking, optionally mixtures of coke naphtha and direct distillation naphtha, or even light coke gas oil. Naphthas from direct distillation in which there has been contamination with antifoaming agents during production of petroleum are also suitable for treatment. Coke naphthas contain cyclosiloxanes that result in typical contents of 1 to 10 ppm of Si in the naphtha, possibly higher.

The adsorbent described in the present invention is composed of a porous support containing lamellar double hydroxide, in particular hydrotalcite, and a group VI-B metal with hydrogenating activity such as Mo, W. Optionally, the group VI-B metal can be promoted by a group VIII metal, such as Ni, Fe, Co, or only group VIII metal can be used. Metals such as Mo and W are preferred as they maintain hydrogenating capacity even in the presence of sulphur-containing compounds, such as are encountered in coke naphtha.

Hydrotalcite—lamellar double hydroxide of Mg and Al—is particularly preferred for preparing the improved adsorbent for use in the process of the present invention.

One or more metals with hydrogenating capacity can be supported on the surface of the hydrotalcite, or can have been added to the actual structure of the lamellar double hydroxide, in complete or partial substitution. Thus, as an example, but without limiting the scope of the present invention, the divalent metal, usually Mg, can be exchanged for Ni, or the trivalent metal, substituted by Fe instead of Al.

It will be apparent to a person skilled in the art that various combinations of metals in lamellar double hydroxides can be employed in the present invention. Various methods of impregnation of solutions of metals on porous solids can also be used to obtain the improved adsorbent of the present invention.

In the process, said contaminated hydrocarbon stream is contacted with the adsorbent of the present invention. A desirable means of contact is the use of a reactor with the adsorbent in a fixed bed. Other possible ways of promoting contact between the phases are moving beds or fluidized beds. A fixed bed is preferably used. In the case of a fixed bed there is no replenishment of the adsorbent, and the available volume of adsorbent and the content of silicon in the hydrocarbon will define the time for saturation of the bed. Typically, a space velocity (LHSV) from 1 to 20 $h^{-1}$, preferably from 2 to 5 $h^{-1}$, is used.

When the adsorbent is prepared, it undergoes calcination after impregnation of the metals, for formation of the metal oxides, which will then be sulphided forming metal sulphides, both in the presence of the sulphur present in the hydrocarbon feed and arising from the sulphiding process. The stage of calcination of the catalyst causes loss of $CO_2$ and $H_2O$ from the composition of the hydrotalcite, resulting in production of mixed oxides, which are undesirable in the present invention. We therefore require a stage of regeneration to the phase of lamellar mixed hydroxide, which is obtained from contact of the adsorbent material with $CO_2$ and $H_2O$.

Preferably, a stage of sulphiding of the metals deposited on the adsorbent is carried out prior to or in conjunction with the stage of recovery of the hydrotalcite. However, it is possible to carry out the sulphiding of the metals in conjunction with the processing of the feed, but better hydrogenating activity is obtained with sulphiding beforehand.

The first contact with water must be carried out in conditions in which the water is not present in liquid phase. Accordingly, the preferred temperatures are always above 100° C., preferably above 110° C., but not above the temperature for the condition of adsorption. Temperatures in this stage are from 80° C. to 360° C., preferably from 110° C. to 360° C., more preferably from 120° C. to 220° C.

Different partial pressures of water and $CO_2$, added to a diluent gas, such as $H_2$ or $N_2$, can be used for the stage of regeneration of the lamellar double hydroxide. Streams available in the refinery, which contain $H_2O$ and $CO_2$, can be used. The total amount of $H_2O$ and $CO_2$ supplied to the adsorbent must be greater than the stoichiometric. In practice, a value of twice the stoichiometric for forming the lamellar double hydroxide is sufficient. Different regeneration times, and flow rates of $H_2O$ and $CO_2$ can be combined, resulting in amounts of $H_2O$ and $CO_2$ greater than the stoichiometric, and without altering the invention.

The pressures in the stage of regeneration of the lamellar double hydroxide are less than or equal to the pressure of the adsorption condition. Preferably, the preferred pressure range for formation of the phase of lamellar double hydroxide is located between 0.05 and 5.0 $MPa_g$, preferably between 0.05 and 2.0 $MPa_g$, more preferably from 0.05 to 0.2 $MPa_g$.

As a possible embodiment of the invention, the regeneration of the phase of lamellar double hydroxide is carried out during trapping (contact of the hydrocarbon feed with the adsorbent). As the time for carrying out the regeneration of the phase of lamellar double hydroxide is short, compared to the time for saturation of the adsorbent, it is possible to carry out the regeneration of the phase in the conditions of processing of the feed. This eliminates stages of cooling, and of pressurization/depressurization of the unit.

The trapping stage is carried out at a temperature from 80° C. to 360° C., preferably from 160° C. to 320° C., more preferably from 220° C. to 280° C. The pressure is from 0.5 to 5.0 $MPa_g$, preferably from 1.5 to 3.0 $MPa_g$. Pressures greater than 5.0 $MPa_g$ can be used in the present invention, but in practice the gain in hydrogenating activity would not make up for the increased cost of equipment. The present invention, using lamellar double hydroxides for adsorption of Si compounds, can however be used in available units, of higher pressure, without altering the scope of the invention.

The pressure in the trapping conditions is maintained by feed of a stream containing hydrogen. The hydrogen used can be derived from hydrogen recycling combined with a replacement stream, or simply be the replacement stream of another unit or reaction stage such as hydrofining, passing previously through the bed for removal of Si compounds. The $H_2$/feed ratio must be at least 10 $Nm^3$ of $H_2/m^3$ of feed, preferably between 50 and 500 $Nm^3$ of $H_2/m^3$ of hydrocarbon feed being processed.

Without limiting the present invention to an explanation of the phenomenon of adsorption of Si compounds, it is believed that the group VI-B hydrogenating metal, such as Mo, is responsible for the ring opening of cyclosiloxanes, which are then adsorbed in a manner analogous to alumina, by reaction with the surface hydroxyls. We can thus see the importance of working in temperature conditions not exceeding 360° C., preferably below 320° C., more preferably below 280° C. Above these temperature conditions, the number of hydroxyls exposed on the surface decreases. This explanation of the phenomenon of trapping of Si compounds on hydrotalcite does not, however, limit the scope of the invention, and is presented for purposes of illustration.

Preferably, water is added to maintain the adsorbent in the condition of lamellar mixed, hydroxide, with the maximum possible number of hydroxyls exposed on the surface of the catalyst. For this, the water flow rate is from 0.01% to 100% of the volume of hydrocarbon feed processed, preferably from 0.1% to 20%, more preferably from 0.1% to 10% of the volume of hydrocarbon feed processed. When a hydrogen recycle stream is used, there is usually $H_2O$ partial pressure in the gas, arising from the feed of $H_2O$ to the gas stream before the gas/liquid separator, to prevent formation and deposition of acid ammonium sulphide in the process equipment (as occurs in the presence of $NH_3$ and $H_2S$). The temperature rise in the gas/liquid separator, for example, can be utilized for increasing the water partial pressure in the recycle gas, and consequently the value of the percentage of water supplied, per volume of feed.

Besides the presence of water vapour in the recycle gas, addition of water can be intermittent or continuous. The water can be recycled after the trapping section or can be added and removed continuously.

$CO_2$ can be added only in the stage of recovery of the lamellar double hydroxide, or can be added continuously, including in the trapping stage.

The stage of recovery of the lamellar double hydroxide can be carried out several times, if there is a decrease in capacity for retention of the Si compounds.

Moreover, as will be obvious to a person skilled in the art, the activation of the adsorbent (obtaining the phase of lamellar double hydroxide) can be carried out prior to loading of the adsorbent in the equipment for contact with the hydrocarbon stream.

The present invention can be applied to an existing unit for hydrofining of coke naphtha, or to a new unit. The adsorbent can occupy an entire reactor, more than one reactor, or only a section of the reactor.

The coke naphtha and mixtures of coke naphtha and naphtha from direct distillation contain dienes, in addition to olefins, sulphur-containing, nitrogen-containing and oxygen-containing compounds. The naphtha must be hydrofined prior to processing in a catalytic reforming unit, for production of aromatics or high-octane gasoline. However, the presence of dienes makes hydrogenation necessary before the increase in temperature in the usual conditions of hydrofining (above 240° C.). The dienes oligomerize and form deposits in the heat exchangers and reactor tops, increasing the loss of pressure and premature shutdown of the units. Thus, selective hydrogenation is usually employed in milder conditions, 160-200° C., in liquid phase, hydrogenating only the dienes.

The adsorbent of the present invention can replace the catalysts for selective hydrogenation, promoting the hydrogenation of dienes (provided it has hydrogenating metal) and the trapping of Si, prior to processing in the main reactor (or main reactors) of HF. In these conditions, it operates in the temperature range 160-200° C. In another embodiment of the invention, trapping of Si can be carried out before the reactor for selective hydrogenation, at a temperature from 80° C. to 160° C.

In the preferred embodiment of the present invention, the adsorbent remains in the reactor or section of reactor at higher temperatures, after the reactor for selective hydrogenation (if present). In these conditions, the temperature is from 220° C. to 360° C., preferably 220° C. to 320° C., more preferably 220° C. to 280° C. If the hydrogen feed is coke naphtha, preferably a substantial proportion of the olefins is also hydrogenated, and some hydrodesulphurization is carried out. The bed of adsorbent can be separated into two sections of a single reactor or two reactors, with intermediate injection of feed or gas or water, for lowering the temperature—resulting from the release of heat in the case of hydrogenation of the olefins—and operating in the ideal conditions for trapping of Si.

A possible embodiment of the present invention, for hydrofining and removal of the Si compounds from coke naphtha, would involve the use of a reactor for selective hydrogenation of dienes, two reactors containing the adsorbent of the present invention, also functioning as hydrofining catalyst, and a final hydrofining reactor. Thus, the coke naphtha would be fed to the first reactor for selective hydrogenation of dienes, would be heated up to the conditions for trapping of Si, where the olefins would be hydrogenated and the Si compounds removed, then proceeding to the final hydrofining reactor. The section for removal of Si would preferably be constituted of two reactors, which could operate independently or usually in sequence. The heat of reaction arising from the hydrogenation of the olefins would be distributed in the two reactors. After saturation of the first reactor, the second reactor would be able to continue in operation for trapping of Si, while the first reactor would be discharged and reloaded with more adsorbent. Advantageously, the final hydrofining reactor would never receive naphtha contaminated with Si, and would be able to operate at lower temperatures in the case of prior hydrogenation of part of the olefins, which reduces the undesirable recombination of $H_2S$ with olefins, forming mercaptans.

Another embodiment would be to use the adsorbent at the end of a hydrofining react r before a unit for catalytic reforming. In this case, the reactors upstream capture some of the Si, and the adsorbent serves as a safeguard, for removing any remaining Si compounds.

Other possible schemes for implementing the invention consist of the use of combined charging of hydrofining catalysts, used or not, with the adsorbent. Even the used catalyst, already saturated with Si compounds, still retains some hydrogenolysis/hydrogenation capacity. Charging can be carried out as a mixture of the two adsorbents, or as in-bed charging, with the catalyst with hydrogenation capacity before an adsorbent section.

Forms of contact of the adsorbent with the contaminated hydrocarbon stream can take place in plug-flow reactors or mixing reactors. In plug-flow reactors, the bed can be fixed, the preferred form of contact, or else in fluidized bed (adsorbent confined in the reactor, but with the bed expanded), or entrainment bed (adsorbent continuously entrained). In mixing reactors, the usual form of contact is a bed of mud, where the adsorbent is injected together with the feed (in conditions where liquid is present).

The following form part of the prior art and are also applied here for the present process:

(a) means for heat exchange that raise the temperature of the streams for the conditions desired in the invention,
(b) means for promoting the transport of the streams,
(c) means for separating the products,
d) means for recycling streams containing $H_2$, $CO_2$ and $H_2O$,
(e) means for discharging the saturated adsorbent and charging fresh adsorbent,
(f) means for manufacturing the adsorbent claimed in the present invention.

A method for production of the adsorbent is described below. It uses a powder of lamellar double hydroxide, specifically hydrotalcite, manufactured by Süd-Chemie AG with the trade name Sorbacid or Syntal. The Mg:Al ratio can be variable, preferably from 10:1 to 2:1, more preferably a ratio 3:1.

The lamellar double hydroxide can also be mixed with small amounts of powdered hydrated alumina, preferably less than 10 wt. % of the hydrotalcite+hydrated alumina mixture, to improve the extrusion properties of the mixture. The content of lamellar double hydroxide in the mixture of the hydroxide with alumina must be greater than 50 wt. %, preferably greater than 65 wt. %, more preferably greater than 85 wt. %, and even more preferably greater than 90 wt. %.

The stage of homogenization of the mixture of hydrated alumina and lamellar double hydroxide takes place for 5 to 60 minutes, preferably for 10 to 30 minutes. Water is added until the mixture is converted to a paste. The oxide paste is fed into an extruder to form extrudates of the desired size and geometry.

The extrudates are dried at a temperature of 100° C. to 160° C. for 1 to 16 h and calcined at 250° C. to 900° C., preferably 350° C. to 700° C., for 1 to 16 hours.

An impregnating solution is prepared by dissolving ammonium, heptamolybdate tetrahydrate in a basic or acid solution. Optionally, if a group VIII metal is used, such as cobalt or nickel, it is possible to select hydroxides, carbonates, nitrates in ammoniacal solution, chlorides, nitrates, sulphates or carboxylates. In the particular embodiment using Ni and Mo, a preferred Mo/Ni molar ratio is from 2 to 5.

The concentration of the impregnating solution can be adjusted using deionized water, so that the volume of the solution is less than or equal to the total pore volume of the extrudate. The pH of the solution is modified with base or acid to obtain the desired point zero charge (PZC). The impregnating solution is then sprayed on the extrudate to provide homogeneous distribution of the metal on the support. The metallic extrudates are then left for 1 to 10 hours to ensure the desired dispersion of metal on the support.

Finally, extrudates containing metal(s) are dried at 100° C. to 160° C. for 1 to 16 h and calcined between 200° C. and 900° C., preferably from 250° C. to 700° C. for 1 to 16 h in air or controlled atmosphere.

Other methods of preparation are known by a person skilled in the art, and are adapted for preparation of lamellar double hydroxide as porous support, with deposition (or total or partial replacement of metals constituting the support) of metals of group VI-B and/or group VIII.

The final amount of $MoO_3$ or other group VI-B metal in the adsorbent after calcination is less than 20%, preferably from 1% to 10%, more preferably from 1% to 5% by weight. In a preferred embodiment of the present invention, group VIII metals can also be used. Preferably, the content of hydrogenating metals is low, to maintain a larger exposed area of adsorbent.

Apart from hydrotalcite, other lamellar double hydroxides can be used in the present invention.

The lamellar double hydroxides have the general chemical formula $$[M_{1-x}^{II}M_x^{III}(OH)_2]^{x+}(A_{x/n}^{n-})mH_2O$$

where $M^{II}$ is a divalent cation (Mg, Mn, Fe, Co, Ni, Cu, Zn, Ga) and $M^{III}$ is trivalent (Al, Cr, Mn, Fe, Co, Ni and La). $A^{n-}$ represents an anion of valence n−, usually inorganic ($CO_3^{2-}$, $OH^-$, $NO^{3-}$, $SO_4^{3-}$, $ClO_4^-$, $Cl^-$), heteropolyacids or even anions of organic acids. Typically, $0.2 \leqq x \leqq 0.33$, and m is less than 0.625. The aforementioned hydrotalcite has the formula:

$$[Mg_{0.75}Al_{0.25}(OH)_2]0.125(CO_3)0.5H_2O.$$

It will be obvious to a person skilled in the art that these means of preparation of the adsorbent are mentioned purely as examples and must not be regarded as limiting the scope of the invention.

Without limiting the claims of the present invention to a mechanism of adsorption of Si compounds onto the lamellar double hydroxide, it is believed that the presence of a larger number of hydroxyls exposed on the surface, obtained in accordance with the operating conditions claimed in the present invention, are responsible for the capture of the Si compounds in a manner analogous to alumina.

Moreover, it is believed that the presence of hydrogenating metal is Important for the capture of cyclic Si compounds, cyclosiloxanes, of low molecular weight, such as those present in coke naphtha. For adsorbing polymeric compounds of high molecular weight, such as the original silicone, it is possible to use microporous solids without any functionality—said compounds enter the microporous solid and are difficult to remove. A purely physical adsorption can remove said compounds from a solution. The products of degradation of silicone can no longer be adsorbed by purely physical means. Consequently, it is believed that a number of results presented in the literature are not valid for the case of cyclosiloxanes, as the results were obtained with the adsorption of silicone polymer. In the examples that illustrate the present invention, cyclosiloxanes are prepared that are identical to those present in coke naphtha, to illustrate the concept of removal of Si with the actual compound.

To demonstrate the application of the present invention, both the production of compounds that are representative of the cyclosiloxanes and the adsorption thereof on the lamellar double hydroxide adsorbent hydrotalcite, are presented in the examples described below.

Other interpretations of the nature and of the mechanism of adsorption do not alter the innovation provided by the present invention, which will now be illustrated by the following examples, which must not be regarded as limiting it.

EXAMPLES

An adsorbent obtained by the Impregnation of Ni and Mo on hydrotalcite was used for the following examples.

Example 1

Preparation of Hydrocarbon Feed Containing Si (in the Form of Cyclosiloxanes)

A certain volume of silicone oil (commercial antifoaming agent) was maintained at the bottom of a closed vessel with electric heating and controlled temperature. The vessel was heated to 500° C., In inert atmosphere (oxygen-free) and a stream of n-heptane was circulated continuously through the heated vessel. The vapour collected from the vessel was condensed, recovering a yellowish liquid.

Atomic absorption spectrometry for analysis of the content of Si in the stream recovered from the reactor showed an Si content of 0.4%.

The mixture was diluted with more n-heptane, resulting in naphtha with Si content of 1200 ppm. Dimethyl disulphide (DMDS) was added to the mixture, so that it contained 1000 ppm of sulphur, with the aim of preventing desulphiding of the Mo present in the adsorbent.

Example 2

Preparation of the Adsorbent and Activation

The adsorbent was prepared from hydrotalcite, Mg:Al ratio of 3:1. Ni and Mo were impregnated on the support, resulting in a solid containing 5% of $MoO_3$ and 1% of NiO, after calcination. Firstly, 5 mL of the adsorbent (equivalent to 3.743 g) was submitted to sulphiding, in a fixed-bed reactor. A mixture of direct-distillation naphtha with DMDS (10000 ppm of sulphur) was processed with LHSV of 3 $h^{-1}$ at 20 bar, $H_2$/feed ratio of 200 NL/L and temperatures of 230° C. for 2 h, heating at 1° C./minute up to 320° C. and remaining in these conditions for 2 h. The next stage was activation of the adsorbent: the reactor was cooled to 140° C. and then depressurized to 0.1 $MPa_g$ maintaining inert atmosphere of $N_2$, with flow rate of 3 NL/h. Then water flow rate of 2 mL/h and $CO_2$ flow rate of 0.1 NL/min were established, for 2 h. The conditions were maintained for 3 h. The amount of water and $CO_2$ supplied to the system were greater than were required for restoring the hydrotalcite phase.

Example 3

Stage of Removal of the Si Compounds

The hydrocarbon feed containing Si obtained in Example 1 was processed in the same reactor containing the regenerated adsorbent, described in Example 2.

The space velocity of addition of the feed (LHSV) was 3 $h^{-1}$, equivalent to 15 mL/h of feed of naphtha contaminated with Si.

The preferred operating conditions were: temperature 265° C., pressure 2 $MPa_g$, $H_2$ flow rate 300 NL/L, $H_2O$ flow rate 2 mL/h. The feed was processed in the reactor, and samples were taken from time to time for analysis of Si. When the content of Si in the product was equal to that of the feed (1200 ppm) the unit was stopped.

Table 1 shows the results obtained during evaluation of the efficiency of the process of the present invention, which reduces and/or eliminates the silicon contaminants by means of the process of adsorption on hydrotalcite.

TABLE 1

| Samples | Cumulative Time (h) | Si Content of Product (ppm) | 100x Si/catalyst (%) | 100x $SiO_2$/catalyst (%) |
|---|---|---|---|---|
| 1 | 0.00 | 0 | 0.00 | 0.00 |
| 2 | 8.00 | 110 | 2.57 | 5.50 |
| 3 | 23.75 | 180 | 7.23 | 15.47 |
| 4 | 27.75 | 760 | 8.05 | 17.22 |
| 5 | 31.75 | 990 | 8.41 | 18.00 |

TABLE 1-continued

| Samples | Cumulative Time (h) | Si Content of Product (ppm) | 100x Si/catalyst (%) | 100x $SiO_2$/catalyst (%) |
|---|---|---|---|---|
| 6 | 47.75 | 1000 | 9.33 | 19.97 |
| 7 | 95.75 | 1200 | 10.68 | 22.85 |

At the time stated in the table, a sample of the effluent was drawn off and was analysed for content of Si. It was assumed that the average content of Si in the product collected in a given interval would be equal to the mean value of the results of the previous and current analyses. Thus, we calculated the mass of Si removed, and the average content of contaminant accumulated in the adsorbent, expressed as Si or $SiO_2$.

The results show high capacity for adsorption in the present process, up to 22.85% of $SiO_2$ in the catalyst bed in conditions of saturation of the catalyst.

The adsorbent in the present process is not an alumina, yet is able to adsorb larger amounts of Si than catalysts supported on aluminas with large surface area, specially prepared for this purpose.

The invention claimed is:

1. Process for removing silicon compounds from hydrocarbon streams by means of adsorption, characterized in that the process comprises the following stages:

a) activation of the adsorbent, initially mixture of oxides of divalent and trivalent metals to form a lamellar double hydroxide by addition of $H_2O$ and $CO_2$ at a temperature from 80° C. to 360° C.;

b) contact of the hydrocarbon feed with the adsorbent at a temperature from 80° C. to 360° C., at a pressure in the range from 0.5 to 5.0 $MPa_g$ maintained for $H_2$/feed ratio from 10 to 1000 $Nm^3$ of gas/$m^3$ of feed, and space velocity LHSV from 1 to 20 $h^{-1}$;

c) maintaining said adsorbent in the condition of lamellar mixed hydroxide, by continuous addition of $H_2O$, the water flow rate being from 0.01% to 100%, of the volume of the hydrocarbon feed being processed;

d) recovery of the hydrocarbon stream free from Si compounds;

where the composition of said adsorbent comprises a mixture of:

(I)—lamellar double hydroxide;

(II)—group VI-B or group VIII metal.

2. Process for removing silicon compounds from hydrocarbon streams according to claim 1, characterized in that the lamellar double hydroxide, after the stage of activation, has the formula:

$$[M_{1-x}^{II}M_x^{III}(OH)_2]^{x+}(A_{x/n}^{n-})mH_2O$$

where: $M^{II}$ is a divalent cation, selected from Mg, Mn, Fe, Co, Ni, Cu, Zn, Ga and $M^{III}$ is a trivalent cation, selected from Al, Cr, Mn, Fe, Co, Ni and La; $A^{n-}$ represents an anion of valence n−, selected from $CO_3^{2-}$, $OH^-$, $NO^{3-}$, $SO_4^{3-}$, $ClO_4^-$, $Cl.^-$, acetate, oxalate; x has a value between 0.1 and 0.5 and m is less than 0.625.

3. Process for removing silicon compounds from hydrocarbon streams according to claim 1, characterized in that the composition of the adsorbent includes, in the hydrated state, a lamellar double hydroxide of Mg and Al.

4. Process for removing silicon compounds from hydrocarbon streams according to claim 3, characterized in that the Mg/Al molar ratio in the lamellar double hydroxide of Mg and Al is 10 to 2.

5. Process for removing silicon compounds from hydrocarbon streams according to claim 1, characterized in that the group VI-B metal is Mo.

6. Process for removing silicon compounds from hydrocarbon streams according to claim 1, characterized in that the content of the group VI-B hydrogenating metal in the adsorbent is less than 20%.

7. Process for removing silicon compounds from hydrocarbon streams according to claim 1, characterized in that the adsorbent plus the group VI-B metal are promoted by Ni or Mo or a group VIII metal.

8. Process for removing silicon compounds from hydrocarbon streams according to claim 7, characterized in that the content of the group VI-B hydrogenating metal plus the group VIII metal in the adsorbent is less than 20%.

9. Process for removing silicon compounds from hydrocarbon streams according to claim 4, characterized in that the metal is in the form of sulphide during the processing of the hydrocarbon feed.

10. Process for removing silicon compounds from hydrocarbon streams according to claim 7, characterized in that the group VI-B and VIII metals are in the condition of sulphide during the processing of the hydrocarbon feed.

11. Process for removing silicon compounds from hydrocarbon streams according to claim 1, characterized in that the stage of activation of the adsorbent is carried out during the start of processing of the hydrocarbon feed.

12. Process for removing silicon compounds from hydrocarbon streams according to claim 1, characterized in that $CO_2$ partial pressure from 0.02 to 0.5 MPa is maintained in the stage of activation.

13. Process for removing silicon compounds from hydrocarbon streams according to claim 1, characterized in that $H_2O$ partial pressure from 0.02 to 0.5 MPa is maintained in the stage of activation.

14. Process for removing silicon compounds from hydrocarbon streams according to claim 1, characterized in that the duration of the stage of activation of the adsorbent is the time necessary for formation of the lamellar double hydroxide phase.

15. Process for removing silicon compounds from hydrocarbon streams according to claim 1, characterized in that $CO_2$ partial pressure from 0 to 0.5 MPa is maintained during the trapping stage.

16. Process for removing silicon compounds from hydrocarbon streams according to claim 1, characterized in that contact between the hydrocarbon stream and the adsorbent is promoted in a fixed-bed reactor.

17. Process for removing silicon compounds from hydrocarbon streams according to claim 1, characterized in that contact between the hydrocarbon stream and the adsorbent is promoted in a fluidized-bed reactor.

18. Process for removing silicon compounds from hydrocarbon streams according to claim 1, characterized in that contact between the hydrocarbon stream and the adsorbent is promoted in an entrainment-bed reactor.

19. Process for removing silicon compounds from hydrocarbon streams according to claim 1, characterized in that contact between the hydrocarbon stream and the adsorbent is promoted in a mixing reactor.

20. Process for removing silicon compounds from hydrocarbon streams according to claim 1, characterized in that the adsorbent is loaded in a fixed bed, before a hydrofining catalyst.

21. Process for removing silicon compounds from hydrocarbon streams according to claim 1, characterized in that the adsorbent is loaded in a fixed bed, after a hydrofining catalyst.

22. Process for removing silicon compounds from hydrocarbon streams according to claim 1, characterized in that the adsorbent is mixed in a bed with hydrofining catalyst.

23. Process for removing silicon compounds from hydrocarbon streams according to claim 1, characterized in that the content of lamellar double hydroxide in the adsorbent is greater than 50 wt. %.

24. The process for removing silicon compounds from hydrocarbon streams by means of adsorption according to claim 1, wherein step a) involves a mixture of oxides of divalent and trialvent metals comprising and $Al_2O_3$ to form a lamellar double hydroxide comprising hydrotalcite and occurs at a temperature from 111° C. to 220° C. and a pressure from 0.05 to 2.0 $MPa_g$; wherein step b) occurs at a temperature from 160° C. to 320° C. and a pressure in the range from 1.5 to 3.0 $MPa_g$ with a $H_2$/feed ratio from 50 to 500 $NM^3$ of gas/$m^3$ of feed and space velocity LHSV from 2 to 5 $h^{-1}$; and wherein step c) occurs using a water flow from 0.1% to 20% of the volume of the hydrocarbon feed being processed.

25. The process for removing silicon compounds from hydrocarbon streams by means of adsorption according to claim 24, wherein step a) occurs at a temperature from 120° C. to 160° C. and a pressure from 0.05 to 2.0 $MPa_g$; wherein step b) occurs at a temperature from 220° C. to 280° C.; and wherein step c) occurs using a water flow rate from 0.1% to 10% of the volume of the hydrocarbon feed being processed.

26. The process for removing silicon compounds from hydrocarbon streams by means of adsorption according to claim 3, wherein the Mg/Al molar ratio in the lamellar double hydroxide of Mg and Al is 3 to 1.

27. The process for removing silicon compounds from hydrocarbon streams according to claim 1, wherein the content of lamellar double hydroxide in the adsorbent is greater than 65 wt %.

28. The process for removing silicon compounds from hydrocarbon streams according to claim 1, wherein the content of lamellar double hydroxide in the adsorbent is greater than 85 wt %.

* * * * *